US005311816A

United States Patent [19]

Schliessmann

[11] Patent Number: 5,311,816

[45] Date of Patent: May 17, 1994

[54] METHOD OF APPLYING PRINTED MATTER TO CYLINDRICAL OBJECTS

[76] Inventor: Kurt Schliessmann, Pfarrer-Schwahn-Strasse 20, D-6052 Obertshausen, Fed. Rep. of Germany

[21] Appl. No.: 6,330

[22] Filed: Jan. 21, 1993

[30] Foreign Application Priority Data

Jan. 20, 1992 [DE] Fed. Rep. of Germany ..... 4201377

[51] Int. Cl.[5] ..... B41L 35/14

[52] U.S. Cl. ..... 101/488; 101/35

[58] Field of Search ..... 101/487, 488, 35, 40, 101/38.1, 39, 40.1, 211

[56] References Cited

U.S. PATENT DOCUMENTS

| | | | |
|---|---|---|---|
| 3,469,670 | 9/1969 | Cartwright | 101/40 |
| 3,766,851 | 10/1973 | Sirvet et al. | 101/40 |
| 4,491,613 | 1/1985 | Hahn | 101/40 |
| 4,681,034 | 7/1987 | Schulzen et al. | 101/211 |

FOREIGN PATENT DOCUMENTS

| | | |
|---|---|---|
| 3229815 | 8/1982 | Fed. Rep. of Germany . |
| 3241041 | 3/1984 | Fed. Rep. of Germany . |
| 3310120 | 9/1984 | Fed. Rep. of Germany . |

*Primary Examiner*—Edgar S. Burr
*Assistant Examiner*—Ren Yan
*Attorney, Agent, or Firm*—Darby & Darby

[57] ABSTRACT

A method of applying printing ink to cylindrical objects includes coating the external surfaces of cylindrical objects with migration-preventing plastic material which has an affinity for ink, and advancing the coated objects continuously, in series, one after the other, through an ink application zone wherein printing inks are transferred from a flexible carrier onto the coated surfaces of the objects. The ink sublimes in the heat, and the carrier is under tension during contact with selected portions of coated surfaces of the cylindrical objects which roll along the carrier during passage through an ink application zone. At least the carrier is heated above the sublimation temperature of the printing ink, and a temperature gradient is established in the plastic coats from the inside to the outside prior to, or not later than upon, entry of objects into the ink application zone. To this end, the ink application zone immediately adjoints a production line for the objects. The objects in the production line must be heated to an elevated temperature anyway for the purpose of producing and applying the plastic coats.

7 Claims, 1 Drawing Sheet

METHOD OF APPLYING PRINTED MATTER TO CYLINDRICAL OBJECTS

BACKGROUND OF THE INVENTION

The invention relates to a method of printing on cylindrical objects by resorting to the following steps:

Coating the surface of a cylindrical object with a migration-preventing plastic material that has an affinity for dye, such as printing ink;

Advancing cylindrical objects continuously in a row, one after the other, through an ink application zone in which printing inks are transferred from an endless flexible carrier onto the surfaces of the objects in that the endless, flexible carrier of printing ink, which sublimes in the heat, contacts under tensile stress a portion of the surface of each cylindrical object;

Rolling the cylindrical objects relative to the carrier during advancement through the ink application zone; and Heating at least the auxiliary carrier above the sublimation temperature of the printing inks.

The invention also relates to an apparatus for implementation of the method.

A method of the above outlined character and an appurtenant apparatus are known from published German Pat. application Ser. No. 32 29 815. This publication proposes to advance the cylindrical objects, which are contacted by the ink-bearing carrier, through a heating zone. In the heating zone, the objects and the carrier are heated up so that the printing inks can migrate from the carrier into and diffuse in the plastic layers at the surfaces of the objects. With the known method and the known apparatus, objects can be printed in a highly satisfactory manner. The method is being used in particular for printing on beverage cans with a detailed motif, that is, on beverage cans whose external surfaces bear the name of the manufacturer and identify the contents of the can, together with relatively detailed motifs, similar to printed labels on beverage bottles.

It has been ascertained that the quality of printing in accordance with the proposal in the published German patent application is indeed quite high but that the appearance of the cans will suffer after even slight damage to the plastic layer, e.g., as a result of small scratches on the surface. When handling the cans, for example during filling in the bottling plant of a beverage production facility, where several thousand cans must be handled every hour, such damage cannot always be reliably prevented. As a rule, the damage does not amount to removal of plastic layer down to the bare metal of the can. Rather, the damage is in the form of light scratches or similar flaws which affect primarily the image of the print because, as a rule, a portion of the dye is removed. In order to reduce the adverse effects caused by such scratching to a minimum, attempts were made to introduce the ink deeper into the plastic layer. This can be achieved, for instance, by increasing the temperature in the heating zone. However, an increased amount of energy is required to increase the temperature, and this results in increased costs.

OBJECTS OF THE INVENTION

An object of the invention is to improve the results of the printing without additional expenditures of energy.

SUMMARY OF THE INVENTION

The method of the invention proposes to set up in the plastic material a temperature gradient from inside to outside prior to, or not later than upon, entry of the objects into the ink application zone.

In other words, the temperature of the plastic layer is higher at the inside where it faces the actual core material of the object, e.g., aluminum or tin plate, than at the outside. It is believed that the inks migrate in the direction of this temperature gradient and, of course, in the direction of the higher temperature, so that the inks penetrate deeper into the plastic layer and ultimately deposit therein. The path of penetration of inks remains open so that the inks (coloring agents) remain visible from the exterior of each coated and imprinted object. Small surface scratches will then no longer have the negative effect of affecting the printed pattern. The "depth differences" in ink deposition into the plastic layer are or can be extremely small. Nevertheless, they are sufficient to eliminate the adverse effect of the most frequently occurring defects, such as small scratches.

In accordance with a preferred embodiment of the invention, the temperature gradient is maintained in the ink application zone for at least a portion of the cross-section of the plastic layer. Thus, even if the auxiliary carrier is preheated, for example, and this amounts to a temperature increase at the outside of the plastic film, one still ensures that the ink particles diffusing into the plastic film penetrate to a certain depth.

The temperature gradient can be achieved quite easily by heating the objects, before they enter the ink application zone, to a preset initial temperature. A preset second temperature in the ink application zone is lower than the initial temperature. Since all of the objects are heated to the first temperature, they act not unlike a heat reservoir which cools off from the outside to the inside. The outside of the plastic layer takes on the temperature prevailing in the ink application zone almost immediately after entry into the ink application zone. However, the interior of the plastic film, namely the side facing the metal of the can or the base material of the object, remains longer at a higher temperature. Thus, practically no additional undertakings are necessary to generate the temperature gradient.

This is a great advantage, especially when the heating to the first temperature takes place during manufacture of the objects to which the transfer of printing ink can immediately follow. As a rule, during the manufacture of the objects, a relatively large amount of energy is already expended and this already results in a heating or warm-up of the objects. This is the case, for example, when the objects are manufactured as cans consisting of a one-piece, seamless cylindrical jacket and a base and produced by drawing from punched round sheet metal or by extrusion molding. Extrusion molding is used in particular for the making of aluminum cans, and the starting material consists of disc-shaped aluminum rondes that take on the shape of the can in a multi step pressing procedure. During drawing or during pressing, due to the deformation work a very strong temperature increase takes place in the metal that will impart the desired, initial temperature to the object.

In accordance with a particularly advantageous proposal, the heating will take place during the making of the plastic film. As a rule, the plastic film will be applied to the object and the object is then heated in the furnace or in a similar heating apparatus in order to harden and solidify the plastic film. At the furnace outlet, that is, directly connected with the production of the plastic film, the object has the desired high temperature. Since the outside of the object, that is, the outside of the plastic film, cools off faster than in its interior, the desired temperature gradient is produced automatically as soon as the object leaves the furnace in which it has been heated for setting of the plastic film. In this case, no additional energy at all is needed to print on the objects. Rather, the residual heat that remains in the objects from the manufacturing process can be used to advantage for the transfer of ink. In spite of the savings in energy, a surprising and improved result is obtained in that the thickness of the ink layer in the plastic film is greater than in accordance with known proposals.

In order to improve the steepness of the temperature gradient, one can employ a stop which has a lower temperature than the object and against which the object comes to rest upon entry into the ink application zone. This is of advantage in particular when the ink application zone is located very closely behind the zone where the plastic film or the object has been produced. If the stop has a certain heat conductance, then the temperature at the outer surface of the plastic film can be reduced rather easily and precisely. Examples of acceptable auxiliary stops are a roller or a pair of rollers made of silicone and being rotated during further transport of the objects, so that heat is removed as a result of the stop being in motion.

The temperature gradient can also be produced by the auxiliary carrier if its temperature is lower than that of the objects as the time of initial contact. In such instance, no additional undertakings are required to generate the temperature gradient. It is merely necessary that, upon contact of the object with the carrier, the object be heated enough so that the printing inks will sublime into the plastic film.

The invention also pertains to an apparatus which can be used to implement the method and wherein the ink application zone directly adjoins the station for the production of the articles. In accordance with the invention, the objects are maintained at an elevated temperature for the purpose of producing the plastic film.

As a result of such undertakings, the temperature gradient can be achieved in a simple and advantageous manner. The result of the printing is improved, and in addition, savings in energy can be achieved.

In accordance with a presently preferred embodiment, a heating furnace is provided at the end of the production zone. In this heating furnace, an object to which a plastic film is already applied will be heated enough so that the plastic hardens. The objects heated in this manner will now be moved along into the ink application zone.

It is of particular advantage if the ink application zone has an inlet section having a retaining stop positioned in the direction of advancement of the objects. The retaining stop brakes the objects to such an extent that they can be grasped by a conveyor device in the ink application zone and can be transported through the ink application zone. The retaining stop exhibits the additional advantage that it can contribute to a defined temperature reduction at the outside of the plastic film so that a defined temperature gradient will be attained in the plastic film.

The improved apparatus preferably employs a conveyor with a row of retaining elements for the cylindrical objects positioned one after the other, a device that pulls the endless, flexible, printed carrier under tensile stress through the ink application zone into contact with a portion of the perimeter of a cylindrical object located in the ink application zone, and a device that causes the retaining devices to carry out a rotational movement with respect to the auxiliary carrier. This apparatus corresponds to a certain extent to that known from published German Pat. application Ser. No. 32 29 815 of Schliessmann. But in contrast to the prior proposal, the ink application zone will have no heating device since the heating function is already performed by the existing heating furnace that is located at the inlet to the ink application zone. Thus, in a simple manner and without additional undertakings, highly advantageous effects can be achieved, namely the improvement in printing onto the surfaces of cylindrical objects.

It is desirable to provide a supply spool for unused carrier and a collecting spool for carrier that has run through the ink application zone. The collecting spool will be driven and the supply spool will be braked. Thus, a continuous production with subsequent printing on the cylindrical objects can be carried out.

In accordance with a presently preferred embodiment, the apparatus further comprises means for heating the flexible carrier ahead of the locus of entry into the ink application zone. This renders it possible to heat the carrier to sublimation temperature of the ink or inks with attendant shortening of the interval of ink transfer onto the plastic coats of the objects an a higher output of the improved apparatus.

The novel features which are considered as characteristic of the invention are set forth in particular in the appended claims. The improved coupling device itself, however, both as to its construction and the mode of manipulating the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
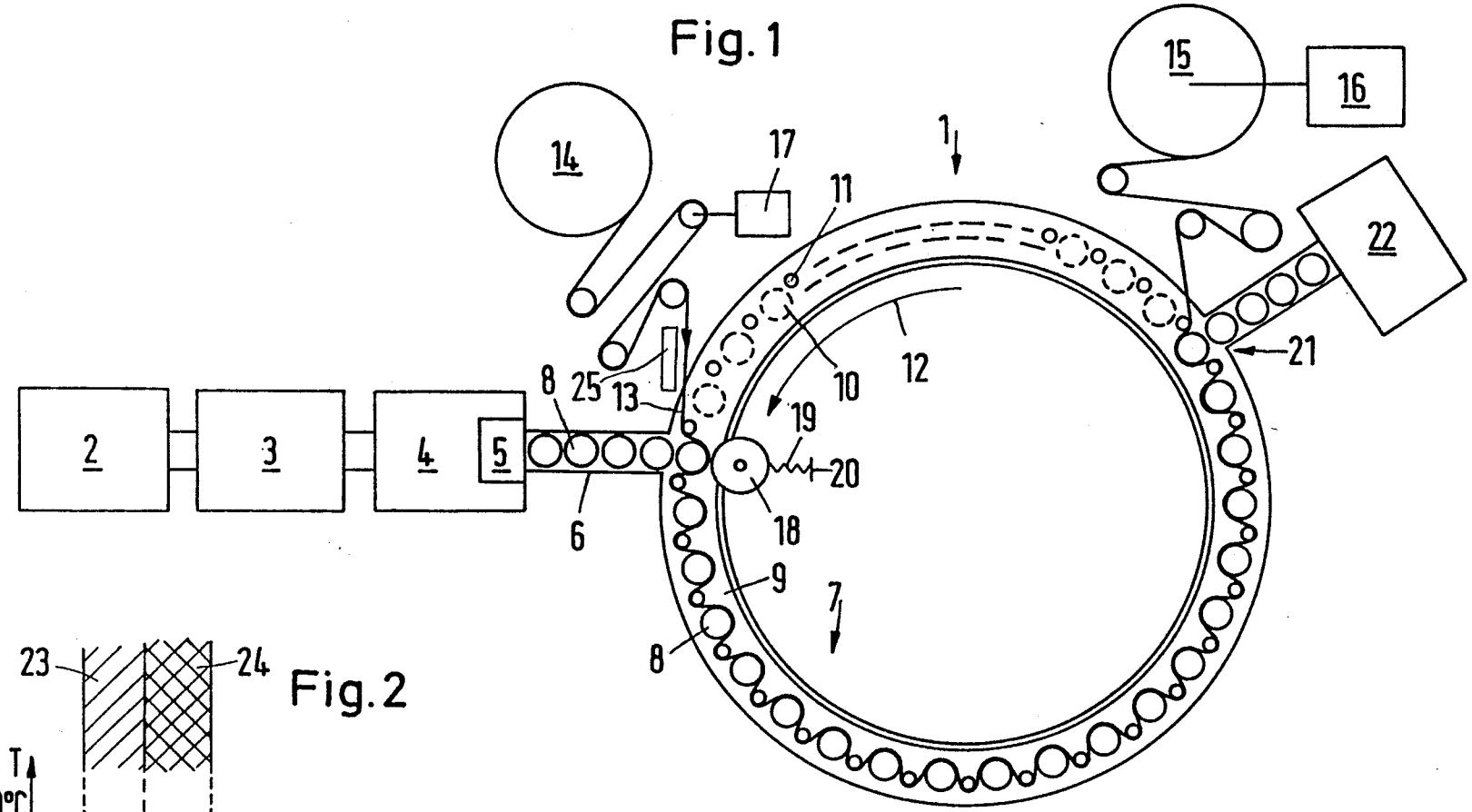
FIG. 1 is a schematic illustration of a production line with a printing device.

A can manufacturing apparatus 1 has a deep drawing or extrusion molding segment 2 which is used for shaping of aluminum rondes, for instance, into cans, where a cylindrical jacket and a base are made of a single piece, that is, the can contains neither a weld seam nor a solder seam. An advantage of such cans is that leakage problems are greatly reduced and one no longer has to undertake steps to ensure that undesirable substances from the soldered or welded seams be kept from getting into the contents of the cans. Instead of aluminum, of course, other materials can be used to make the cans, for instance, metallic materials of the type known from can production. Following the deep drawing segment 2, there is an inner lacquering segment 3 in which the cans are provided with an interior lacquer layer. Since a can has already attained an elevated temperature due to the deep drawing or extrusion molding in the deep drawing segment 2, that is as a result of deformation work occurring in this segment, the lacquer in the interior of the can will harden rather quickly. Adjoining the interior lacquering segment 3, there is an outer coating segment 4 in which the outsides of the cans are provided with plastic films 24 (FIG. 2). Suitable plastics for this plastic film on the surfaces of the cans are those that are known as migration-inhibiting and that have an affinity for printing inks and other dyes. It is immaterial whether the plastic materials are thermoplastics or duroplastics. Examples of such plastics for the surface coating are epoxy resins, silicone resins, phenoplastics, aminoplastics, polyesters, polyphenylene sulfide resins, acrylate resins, alkyd resins, polyethersulfonate resins, polyamideimide resins and others. In particular, polyester resins can be used. Upon application of a plastic film onto the body of a can, the cans and the applied plastic films 24 are heated in a heating furnace 5, and this causes the plastic films 24 to harden. At such time, the cans are heated to temperatures in the range of 200° to 350° C. Thus, the cans which leave the heating furnace 5 and move along a schematically illustrated short conveyor belt 6 to the actual ink transfer zone 7 are already heated to the required temperature at the outlet of the heating furnace 5. However, the cans begin to cool off as soon as they leave the heating furnace 5 and are exposed to a different environment, especially to a cooler surrounding air. The cooling will take place from the outside to the inside, that is, the temperature at the exterior of the plastic film will drop faster than the temperature at the inside of the plastic film because the body of the can and the air, which is enclosed therein and moves little or not at all, act as a heat reservoir. It can be of advantage here if the cans are standing on their tops, i.e., with the bottom up and the unsealed opening pointing down. This will generally prevent the escape of heated air through convection. From the conveyor belt 6 the cans 8 move onto a conveyor device 9 which has alternating mounting features 10 and diverter rollers 11 attached to it. The cans are set onto the mounting features 10 in a known manner, for example, by an inlet gear (not illustrated). The conveyor device 9 rotates in the direction of arrow 12, i.e., counterclockwise as seen in FIG. 1.

Between two diverter rollers 11 there is a flexible carrier 13 which is drawn off a supply roller 14, pulled through the ink transfer zone 7 and convoluted onto a collecting roller 15. The carrier 13 will be called an "lendless band" even though the quantity stored on the supply roller 15 is finite. However, it normally amounts to several hundred, or even several thousand, meters so that it can be used f or a longer production run. The carrier 13 entrains heat-subliming printing inks and is sufficiently flexible to ensure that, when a can 8 is pushed between two diverter rollers 11, it will coil around a portion of the circumference of such can.

The collecting roller 15 is driven by a motor 16. The carrier 13 is braked by a brake 17 in the region of the supply roller 14. The brake 17 can act directly on the supply roller 14. This will ensure that the carrier 13 is maintained under tension in the entire ink transfer zone 7 and is in contact with the cans 8 with a certain tensile stress.

Figure 2:
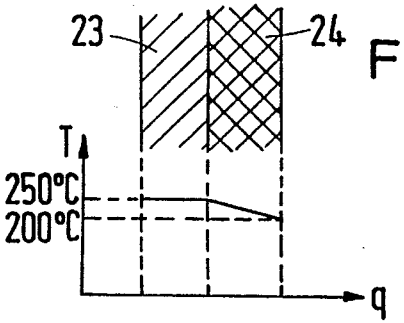
FIG. 2 illustrates a temperature profile along the cross section of a can.

FIG. 1 further shows a heating unit 25 which is adjacent the flexible carrier 13 at the location where successive increments of the carrier are about to enter the ink application zone 7. The unit 25 is designed to heat successive lengths of the carrier 13 to sublimation temperature of the ink or inks. This ensures that the transfer of ink or inks onto the coated surfaces of the objects 8 is completed within shorter intervals of time. In other words, the provision of the heating unit 25 renders it possible to shorten the intervals of dwell of objects 8 in the ink application zone 7 and to thus increase the output of the apparatus. The objects 8 can be transported along their path through the ink application zone 7 at a higher speed. In spite of heating of the running carrier 13 by the unit 25, the aforediscussed temperature gradient remains established, at least within a portion of cross section of plastic layers or coats on the external surfaces of the objects 8.

In the inlet area a mounting stop 18 is biased by a spring 19 which reacts against a machine-mounted base 20. When the cans 8 enter the ink application zone 7, they first press inward the auxiliary carrier 13, which is tensioned between two diverter rollers 11, until they finally come to rest against the mounting stop 18. The mounting stop 18 prevents any further movements of the cans so that the cans come to a reliable stop on the conveyor device 9 where they can be grasped by the mounting fixtures 10 to advance along a predetermined path.

The motor 16 for the collecting roller 15 is controlled in such a way that the carrier 13 will move faster or slower than the conveyor device 9. Thus, the cans 8 can coil onto the carrier 13. The retaining features 10 can now turn on the conveyor device 9 and thus rotate with respect to the carrier 13. When the cans 8 leave the conveyor device 9 at an outlet 21 of the ink transfer zone 7, the entire circumference of each can 8 is provided with printed matter. From the outlet 21 of the ink transfer zone 7, which can be provided with an outlet star-gear (not illustrated), the cans move into a packing station 22.

FIG. 2 shows a cross section through the wall 23 of a can with applied plastic film 24. Underneath is a temperature profile, that is, the profile of temperature T is plotted along the cross section. At the outlet of the heating furnace 5, a can 8 has a temperature (for instance) of approximately 260° C. The cans 8 cool off a little on the conveyor belt 6, and the cooling is more pronounced at the outside of each plastic film than at the inside. For example, the outside of a plastic film will have a temperature of 200° C., while the interior of the can will still have a temperature of 250° C. The temperature at the outside of a plastic film 24 is sufficient to heat the inks on the carrier 13 so that they will sublime into the plastic film 24. The temperature gradient will ensure that a specified depth of the printed layer will be achieved.

Selection of the temperature in the heating furnace 5 is dependent on what temperature is needed to harden the plastic film 24. In addition, it also depends on what temperature is needed to sublime the inks which are supplied by the carrier 13. In this case, a practically complete sublimation is desirable, that is, the inks should sublime up to at least 90%. In order to ensure this level of subliming, the temperature at the outside of the plastic film 24 during passage through the ink transfer zone 7 should be at least 30°, but preferably at least 500° C., above the temperature at which at least 90% of the inks sublime. Since the transport through the ink transfer zone 7 is completed rather quickly, that is, it lasts only a few seconds, the danger of extensive cooling of the cans is relatively low. Also, at the outlet 21 of the ink transfer zone 7, the plastic film 24 still has a high enough temperature to heat the carrier 13 so that a reliable transfer of ink onto the can is possible.

Inks that can be used are known from published German Pat. application Ser. No. 32 29 815; for example, the subliming dyes used in the transfer printing process, like dyes selected from the groups containing anthraquinone, monoazo and azomethine dyes, whose molecules can be heavily substituted with amino, alkoxy, oxalkyl, nitro, halogen and cyano groups. Other useful dye groups are the diazo dyes, nitroacrylamines, quinophthalones and styrene dyes.

Since the temperatures in the heating furnace 5 and in the ink transfer zone 7 are no longer controllable entirely independently of each other, a certain interdependence of the plastic of the film 24 and the inks will result. However, sufficient combinations can be found so that printing on the cans 8 by using the transfer printing process can be effected, even without additional heating of the cans in the ink transfer zone 7.

The invention is susceptible of many additional modifications. For example, a carrier 13 which bears ink at both sides can be used. In such apparatus, the diverter roller 11 can be replaced with other mounting features on the conveyor into which the cans can be inserted. The conveyor can also have a straight shape, instead of a revolving, round shape, and it can be moved periodically back and forth, or have the shape of a conveyor belt the top side of which transports cans through the ink transfer zone and then returns underneath such path. Furthermore, all sample designs illustrated in published German Pat. application Ser. No. 32 29 815 can be used. This renders it possible to dispense with a heating device. Rather, a heating furnace is connected to the inlet of the ink transfer zone in order to achieve the desired temperature gradient from inside to outside.

Published German Pat. application Ser. No. 32 41 041 of Schrieder et. al. discloses a method of and an apparatus for the application of imprinted paper onto the lacquered surfaces of hollow objects. The reference does not disclose or suggest the establishment of a temperature gradient from the inside to the outside of lacquer coats.

The disclosure of published German Pat. application Ser. No. 33 10 120 of Schulzen et. al. is analogous to the disclosure of Schrieder et al. The application of Schulzen et. al. proposes the utilization of a laser beam as a means for promoting the penetration of ink into a plastic coat which is applied to a substrate. There is no suggestion of establishing a temperature gradient in a manner and for the purposes of the method of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of imprinting external surfaces of cylindrical objects, comprising the steps of:

coating the surfaces of said objects with at least one layer of plastic material having an affinity of printing ink to produce a coated object;

establishing a temperature gradient in said plastic material layer, wherein the inside of said layer adjacent said object is at a higher temperature than the outside of said layer, prior to or upon entry of said coated objects into an ink application zone;

conveying successive objects of a series of said cylindrical objects through said zone;

heating in said zone at least a flexible carrier of printing ink above the sublimation temperature of said ink;

transferring the ink from the carrier onto the coated surfaces of said successive objects, wherein the transferring step comprises the steps of tensioning the carrier, contacting the tensioned carrier with the surfaces of successive objects of the series and rolling the objects along the carrier.

2. The method of claim 1, further comprising the step of maintaining the temperature gradient in the ink application zone for at least a portion of the cross section of each plastic layer.

3. The method of claim 1, further comprising the steps of heating the objects to a first predetermined temperature prior to entry into the ink application zone, and maintaining the ink application zone at a predetermined second temperature lower than said first temperature.

4. The method of claim 3, wherein said steps of heating the objects to said first predetermined temperature is carried out in the course of said coating step.

5. A method of imprinting external surfaces of cylindrical objects, comprising the steps of:

forming said cylindrical objects, wherein during said formation step said objects are heated to a first predetermined temperature;

coating the surfaces of said objects with at least one layer of plastic material having an affinity for printing ink to produce a coated object;

establishing a temperature gradient in said plastic material layer, wherein the inside of said layer adjacent said object is at a higher temperature than the outside of said layer, prior to or upon entry of said coated objects into an ink application zone, and wherein said gradient is established by maintaining said zone at a predetermined second temperature lower than said first predetermined temperature;

conveying successive objects of a series of said cylindrical objects into the ink application zone;

heating in said zone at least a flexible carrier of printing ink above the sublimation temperature of said ink; and transferring said ink from said carrier onto the coated surfaces of successive objects, wherein the transferring step comprises the steps of tensioning the carrier, contacting the tensioned carrier with the surfaces of successive objects of the series and rolling the objects along the carrier.

6. A method of imprinting external surfaces of cylindrical objects, comprising the steps of:

coating the surfaces of said objects with at least one layer of plastic material having an affinity for printing ink to produce a coated object;

establishing a temperature gradient in said plastic material layer, wherein the inside of said layer, prior to or upon entry of said coated objects into an ink application zone, wherein said gradient is established by contacting the objects upon entry to said zone with a stop having a temperature lower than the temperature of the objects;

conveying successive objects of a series of said cylindrical objects into the ink application zone;

heating in said zone at least a flexible carrier of printing ink above the sublimation temperature of said ink; and transferring said ink from said carrier onto the coated surfaces of said successive objects, wherein said transferring step comprises the steps of tensioning the carrier, contacting the tensioned carrier with the surfaces of successive objects of the series and rolling the objects along the carrier.

7. A method of imprinting external surfaces of cylindrical objects, comprising the steps of:

coating the surfaces of said objects with at least one layer of plastic material having an affinity for printing ink to produce a coated object;

establishing a temperature gradient in said plastic material layer, wherein the inside of said layer adjacent to said object is at a higher temperature than the outside of said layer, prior to or upon entry of coated objects into an ink application zone;

conveying successive objects of a series of said cylindrical objects into the ink application zone;

heating in said zone at least a flexible carrier of printing ink above the sublimation temperature of said ink;

transferring said ink from the carrier onto the coated surfaces of said successive objects, wherein said transferring step comprises the steps of tensioning carrier, contacting the tensioned carrier with the surfaces of successive objects of the series and rolling the objects along the carrier, and wherein said temperature gradient is established by maintaining the carrier below the temperature of the objects, at least during an initial stage of said contacting step.

* * * * *